US005316400A

United States Patent [19]

Hoyt et al.

[11] Patent Number: 5,316,400

[45] Date of Patent: May 31, 1994

[54] PACKAGE SYSTSEM FOR FLOWABLE OR SOLID SUBSTANCES

[75] Inventors: Earl E. Hoyt, Franklin Lakes, N.J.; James A. Smith, Chatham, Mass.

[73] Assignee: Creative Products Resource, Inc., North Caldwell, N.J.

[21] Appl. No.: 810,309

[22] Filed: Dec. 19, 1991

[51] Int. Cl.[5] ..... A47L 13/17

[52] U.S. Cl. ..... 401/132; 206/469; 222/94; 222/107; 401/196

[58] Field of Search ..... 222/94, 107; 401/132, 401/196; 206/469

[56] References Cited

U.S. PATENT DOCUMENTS

| | | | |
|---|---|---|---|
| 2,102,858 | 12/1937 | Schlumbohm . | |
| 2,517,027 | 8/1950 | Rado | 222/94 |
| 2,621,784 | 12/1952 | Van Boytham . | |
| 2,760,630 | 8/1956 | Lakso . | |
| 2,932,841 | 4/1960 | Graves . | |
| 2,999,265 | 9/1961 | Duane et al. . | |
| 3,053,385 | 9/1962 | Spees . | |
| 3,196,478 | 7/1965 | Baymiller et al. . | |
| 3,224,640 | 12/1965 | Schneider et al. | 222/94 X R |
| 3,240,326 | 3/1966 | Miller . | |
| 3,280,420 | 10/1966 | Wanzanberg . | |
| 3,299,464 | 1/1967 | O'Brien et al. . | |
| 3,323,640 | 6/1967 | Kugler . | |
| 3,369,267 | 2/1968 | Friedland et al. . | |
| 3,429,096 | 2/1969 | Griese, Jr. . | |
| 3,485,349 | 12/1969 | Chaney, Jr. . | |
| 3,527,400 | 9/1970 | Shepherd et al. . | |
| 3,561,456 | 2/1971 | Stuart, Jr. . | |
| 3,608,566 | 9/1971 | Storandt . | |
| 3,608,708 | 9/1971 | Storandt . | |
| 3,613,879 | 10/1971 | Kemble . | |
| 3,616,898 | 11/1971 | Massle . | |
| 3,635,567 | 1/1972 | Richardson, Jr. . | |
| 3,647,305 | 3/1972 | Baker et al. . | |
| 3,826,259 | 7/1974 | Bailey . | |
| 3,860,348 | 1/1975 | Doyle . | |
| 3,889,804 | 6/1975 | Ravich . | |
| 3,903,345 | 9/1975 | Baker et al. . | |
| 3,913,562 | 10/1975 | Moore et al. . | |
| 3,981,304 | 9/1976 | Szpur . | |
| 3,986,640 | 10/1976 | Redmond . | |
| 3,998,559 | 12/1976 | Hoyt . | |
| 4,140,409 | 2/1979 | DeVries . | |
| 4,265,234 | 5/1981 | Schaar . | |
| 4,332,319 | 6/1982 | Hurwood . | |
| 4,360,020 | 11/1982 | Hitchcock, Jr. et al. . | |
| 4,372,098 | 2/1983 | Mason . | |
| 4,427,111 | 1/1984 | Laipply . | |
| 4,427,115 | 1/1984 | Laipply . | |
| 4,430,013 | 2/1984 | Kaufman . | |
| 4,493,574 | 1/1985 | Redmond et al. . | |
| 4,511,533 | 4/1985 | Guadagno et al. . | |
| 4,648,506 | 3/1987 | Campbell . | |
| 4,696,393 | 9/1987 | Laipply . | |
| 4,762,124 | 8/1988 | Kerch et al. . | |
| 4,796,751 | 1/1989 | Madkour . | |
| 4,812,067 | 3/1989 | Brown et al. . | |
| 4,896,768 | 1/1990 | Anderson . | |
| 4,901,851 | 2/1990 | Gerry . | |

FOREIGN PATENT DOCUMENTS

| | | | |
|---|---|---|---|
| 613023 | 1/1961 | Canada . | |
| 2644141 | 9/1990 | France | 222/107 |

OTHER PUBLICATIONS

J. F. Hanlon, "Coatings and Laminations," in *Handbook of Package Engineering* (2d ed.), pp. 4–1 to 4–20 (1984).

Mason-Keller Corporation Information Release entitled "M-K Applicator Package" (Apr. 24, 1978).

*Primary Examiner*—Steven A. Bratlie

*Attorney, Agent, or Firm*—Merchant, Gould, Smith, Edell, Welter & Schmidt

[57] ABSTRACT

The invention is directed to a package for containing and dispensing a solid article including powders and solid objects, and/or flowable substances such liquids, gels and dispersions. When the ends of the package are forced together, a backing sheet is separated from receptacle units to expose openings through which the contents can be dispensed from interior chambers in the package.

18 Claims, 4 Drawing Sheets

FIG.4
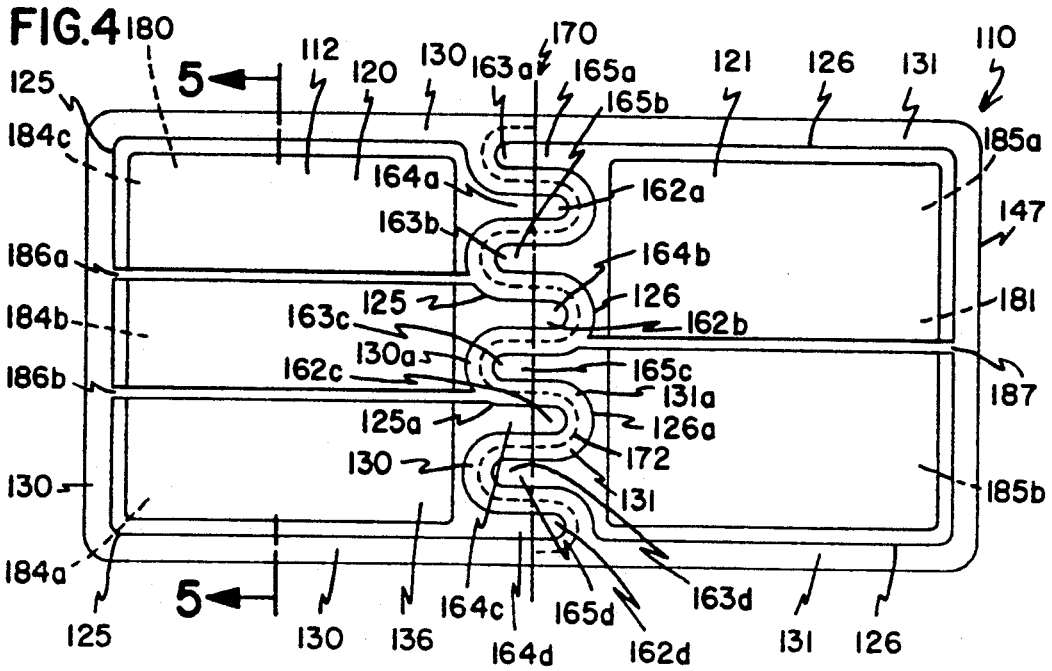
FIG.5
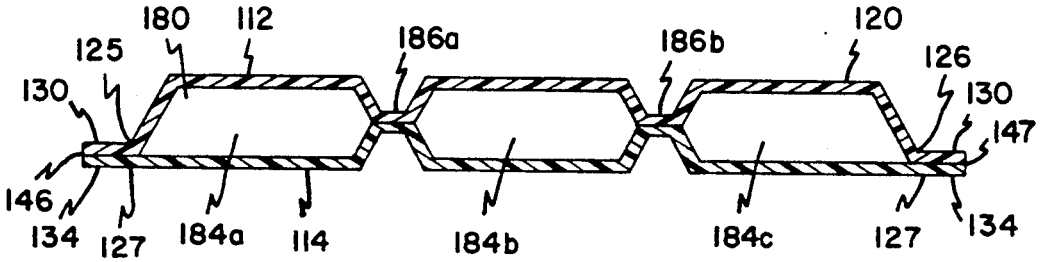
FIG.6
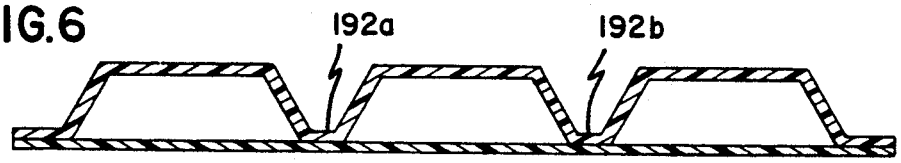
FIG.8
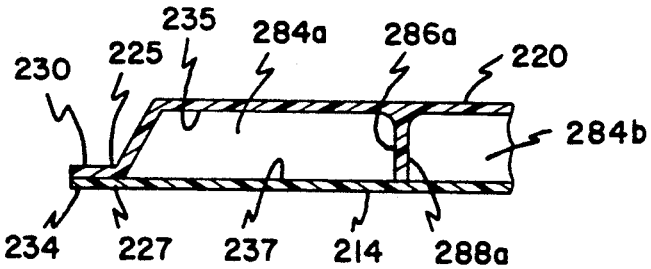
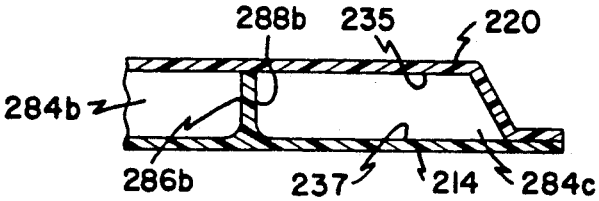
FIG.9

PACKAGE SYSTSEM FOR FLOWABLE OR SOLID SUBSTANCES

FIELD OF THE INVENTION

The invention is directed to a package for containing and dispensing substances such as solid substances and/or flowable substances.

BACKGROUND OF THE INVENTION

Packages are used to contain and protect a substance until it is desired to release the substance from the package. Packages may be used to contain various solid substances or articles, such as powders, pills, granules and other shaped substances. Packages may also be used to contain various flowable substances such as gels, solutions, dispersions, and other dimensionally unstable substances. In some cases, it may be desirable to include structure on the package which assists in dispersing or applying the contents.

Several factors are taken into consideration in providing a package system for dispensing a flowable or solid substance. One concern is the performance characteristics of the dispensing package. For example, the ease with which the package can be opened and its contents expelled can be important. The ability of the package to store and contain a substance prior to its application is another factor. When an applicator is included as part of the package, secure attachment of the applicator to the packaging can be important so that the applicator does not become disengaged during use.

Another consideration in designing a useful dispensing system is the ability to deliver more than one substance from a unitary system. Also desirable is a packaging system that is useful to simultaneously combine and dispense a plurality of substances, each requiring separate storage until being combined, due to their physical or chemical incompatibility.

Various packages have been developed to contain and dispense solutions, dispersions or gels of various active ingredients. One such dispenser is an envelope-like package that defines an internal reservoir for containing a fluid. For example, U.S. Pat. No. 4,427,115 to Laipply, discloses a packaging device for applying various fluids to the skin. The device is made of a flexible sheet of fluid impermeable material that is folded in half and sealed around the edges in a temporary seal. The two halves of the sheet are pulled apart to break the seal and form a flat surface covered with the fluid. An absorbent pad may be adhered inside the chamber to aid in the retention and delivery of the fluid. A disadvantage of this type of package is its limited capacity. Also, the sealed edging may split open, prematurely exposing the contents. Conversely, the edges of the containing packet may be too tightly sealed so that it is difficult to open the packet in a controlled fashion. Additionally, the contents of the packet can often be squeezed out prematurely when the reservoir chambers are accidentally compressed.

Other packaging systems provide for a cup-like reservoir with a foil or paper covering that is torn off to expose the fluid or other material contained within the chamber. For example, Canadian Patent No. 613,023 to Wilson et al. discloses a creamer-type dispenser with a wide-mouthed cup and a covering sheet sealed over the mouth of the cup. The covering sheet has a tab adhesively sealed over a flat extension of the rim of the cup. The package is opened by pulling the tab of the covering sheet upward off the rim extension and inward toward the cup. U.S. Pat. No. 3,860,348 to Doyle et al. discloses a cup with a foil covering over the mouth and a liquid-impregnated sponge attached to the inside of the cup. When the covering is peeled off the rim of the cup, the sponge projects outward through the opening.

The covering lids of these packages may be difficult to remove so that during opening, the contents may spill out of the container due to the upward pulling action to remove the cover.

Packages have also been developed to expel the contents of an inner chamber through a fracture or score line in one surface of the package. The ends of the package are forced together to expand and rupture the score line. For example, U.S. Pat. No. 3,986,630 to Redmond discloses a dispensing package having a single reservoir with a pattern of perforations cut partially through the surface of one side of the package that is covered with a foil sealant.

Several applicator systems with a prescored fracture line in one surface of a package provide for reservoirs in each half of a single package. For example, U.S. Pat. No. 4,140,409 to DeVries discloses a system with a reservoir chamber in each half of an elongated package. A sponge is attached to the outside of the package. The chambers are separated by a partition formed by a prescored portion cut into one surface of the container. A channel extends through the partition to connect the two chambers. When the ends of the package are bent together, the score line ruptures and the contents of the chambers are expelled into the attached sponge.

U.S. Pat. No. 4,430,013 to J. W. Kaufman discloses a dispensing system with a reservoir chamber in each half of an elongated package. A score line extends across the width of the package in between the two chambers. Each of the chambers have a narrowed neck portion that fans out before abutting the score line. This configuration facilitates a controlled flow and distribution of the liquid contents from the two reservoirs into an attached sponge for simultaneous admixture. U.S. Pat. No. 4,812,067 to Brown et al. also provides a system that provides separate reservoir chambers in a flexible package. The chambers are compressed to rupture an internal seal in the package which urges the liquid contents into a central dispensing cavity. The ends of the package are bent backward to split open a score line in the surface of the package. Pressure on the package forces the contents to be expelled through the slit in the score line and onto a sponge attached to the outside of the package.

A disadvantage of packaging devices that release their contents by rupturing a score line in the container wall is that flexing of the package prior to use may cause the fracture line to split apart prematurely, thus causing unwanted leakage or premature dispersal of the contents. Conversely, the score line may be constructed such that it is difficult to break.

Therefore, there is a need for a dispensing system which addresses the above mentioned problems of prior dispensing systems. In particular, there is a need for a packaging system for dispensing flowable and/or solid substances which has an improved configuration for releasing the contents of the packaging that is not prone to premature rupture but provides ready dispensing of the package contents. There is also a need for a packaging that is a convenient means of dispensing flowable and/or solid substances from multiple reservoir chambers within the packaging system.

SUMMARY OF THE INVENTION

The present invention provides a novel package for containing and dispensing solids such as pills, powders or granules, and/or flowable substances such as gels, dispersions or solutions.

In one embodiment of the invention, the dispensing device is made of two receptacle units and a backing sheet. Each of the receptacle units includes a distal end, a proximal end, and peripheral edges that extend completely around the unit. Preferably, peripheral flanges are integrally attached along the peripheral edges of the units and extend outward therefrom. A portion of the proximal end of the receptacle units is formed into one or more projections, or extension member.

The receptacle units are sealed along their peripheral edges to a first surface of the backing sheet, preferably, by the sealed attachment of the peripheral flange of the units to the backing sheet. This attachment defines at least one sealed internal chamber for each receptacle unit for containing a flowable substance or a solid article.

The receptacle units are sealed to the backing sheet with the proximal ends of the units arranged head-to-head, and the extension members of the receptacle units positioned side-to-side and adjacent to each other. In this arrangement, the extension members overlap a bending axis that extends between the receptacle units and across a width of the dispensing device.

The receptacle units may be attached in a discrete fashion to the backing sheet or may be integrally attached together along the region of their peripheral edges adjacent to the extension members. Preferably, the peripheral flanges of the units are integrally attached to each other. Where the units are attached together, a score line is provided thereinbetween so that the units may be detached from each other when the device is opened.

The backing sheet is specifically attached along at least part of the peripheral edges adjacent to the extension members by a releasable seal. This releasable attachment allows the backing sheet to be separated from the extension members when the dispensing device is opened according to the invention. By separating the backing sheet from the extension members, openings are provided into the interior chambers of the dispensing device. The receptacle units may be formed of a plurality of extension members, each of which provide an opening into the interior chamber of the dispenser device.

The receptacle units and backing sheet may be sealed together to form a plurality of sealed interior subchambers thereinbetween. Each of the subchambers would be in communication with at least one extension member.

To dispense the contents from the interior chambers of the dispensing device, the distal ends of the dispensing device are urged together to bend the dispensing device about the bending axis that extends across its width and between the two receptacle units. This movement causes cooperative action between the extension members to separate at least a portion of the backing sheet from the extension members of both receptacle units simultaneously. More particularly, the first receptacle unit acts as a lever to separate the backing sheet from the extension member of the second receptacle unit, and vice versa. If the receptacle units are integrally attached along their peripheral edges adjacent to the extension members with a score line thereinbetween, the receptacle units may be disconnected by separation of the score line during bending of the dispenser device. Openings in the extension members into the interior chambers of the dispensing device are thus uncovered by separating the backing sheet from the extension members. The substance within the chambers may be dispensed through the openings provided in the extension members.

Optionally, a means for dispensing and/or applying the contents of the dispensing device, such as an absorbent sponge or porous sheet, may be secured to the exterior surface of the receptacle units over a portion of the extension members and openings. The contents of the dispensing device may be released from the chambers into the dispenser or applicator.

In another embodiment of the invention, the dispensing device includes a receptacle unit, an opening member, and a backing sheet. The receptacle unit and the opening member are sealed to a first surface of the backing sheet. The receptacle unit and opening member each have a distal end and a proximal end, and peripheral edges that extend completely around the opening member and the receptacle unit, preferably, peripheral flanges are integrally attached to the peripheral edges. The proximal ends of the receptacle unit and the opening member are formed into at least one extension member.

The opening member of the dispensing device is similar in some respects to the second receptacle unit of the dispensing device described hereinabove for the first embodiment of the invention. However, the opening member does not include an interior chamber for containing a substance to be dispensed. Preferably, the opening member is abbreviated in length, compared to the length of the first receptacle unit. The opening member, although different in appearance to the second reservoir unit of the first embodiment, functions in similar fashion in cooperating with the first receptacle unit to open the dispensing device. The opening member functions to separate the backing sheet from a portion of the extension members of the receptacle unit to reveal openings into the interior chambers of the unit. Where desired, the opening member may form a second receptacle unit.

The first receptacle unit is sealed to the backing sheet to form at least one sealed interior chamber thereinbetween. The receptacle unit and the opening member are positioned on the backing sheet with their proximal ends arranged head-to-head so that the extension members overlap a bending axis extending between the receptacle unit and the opening member and across the width of the dispensing device. The receptacle unit and opening member may be separate or integrally attached together with a score line thereinbetween, similar to the first embodiment.

As in the first embodiment, the backing sheet is attached by a releasable seal to at least part of the peripheral edges adjacent the extension members. When the dispensing device is bent about the bending axis extending the width of the dispensing device, the extension members are separated from the backing sheet. Openings are provided into the interior chamber of the dispensing device through the extension members.

The interior chambers of the receptacle units may be further divided into one or more subchambers to provide separate containment of the flowable substance or solid article. For example, the receptacle unit may be sealed to the backing sheet, for example by adhesive attachment or heat sealing, along its length to provide one or more divider walls and, thus, subchambers in the unit. In another example, the receptacle unit and/or backing sheet may be formed with a partition structure. When the receptacle unit and the backing sheet are sealed together, divider walls are formed within the interior chamber to provide subchambers therein. Each subchamber may separately and sealably contain a desired substance. Each subchamber is in communication with at least one extension member to provide an opening for dispensing the substance or article therefrom when the dispensing device is opened.

The present invention provides a convenient dispensing device that securely contains a flowable substance and/or solid article which can be easily dispensed from the device by bending the ends of the package together to expose openings into the interior chambers.

These and other advantages of the invention over conventional dispensing devices will become more apparent after reading the description and claims which follow.

BRIEF DESCRIPTION OF THE DRAWINGS

Throughout the following views, reference numerals will be used on the drawings, and the same reference numerals will be used throughout the several views and in the description to indicate same or like parts of the invention.

FIG. 4 is a top view of a second embodiment of the dispensing device, showing a plurality of extension members and interior subchambers.

FIG. 5 is a cross-sectional view of the dispensing device shown in FIG. 4, along line 5—5, showing subchambers of the first receptacle unit.

FIG. 6 is a cross-sectional view of an alternative dividing wall shown in FIG. 5, along line 5—5.

FIG. 8 is a cross-sectional view of the dispensing device shown in FIG. 7, along line 8—8.

FIG. 9 is a cross-sectional view of an alternative dividing wall shown in FIG. 8, along line 9—9.

DETAILED DESCRIPTION OF THE INVENTION

Figure 1:
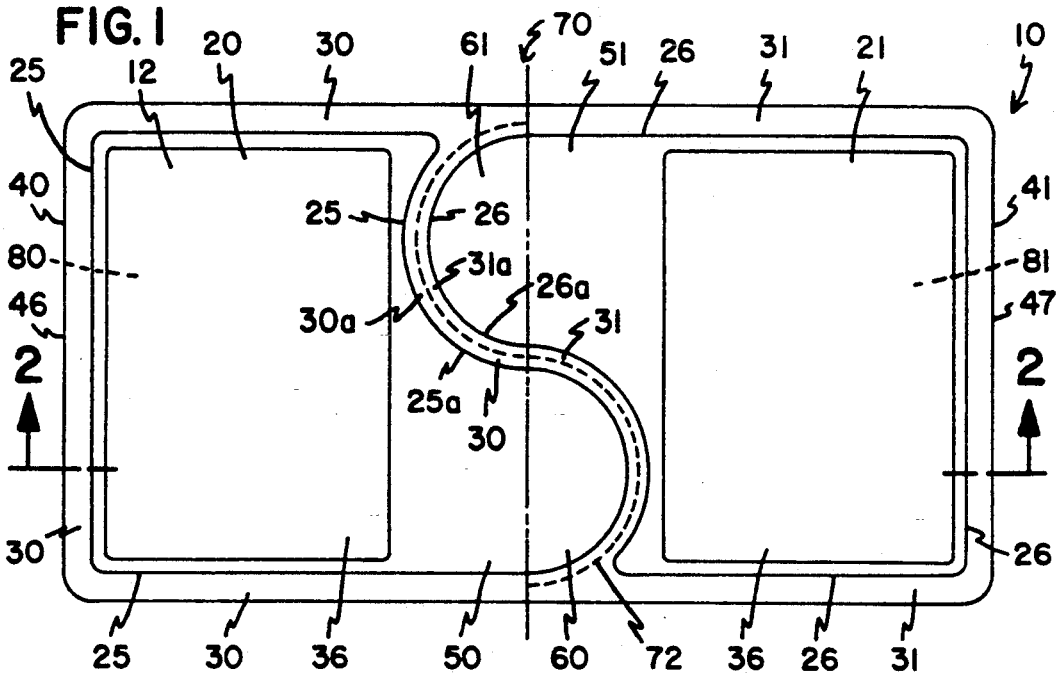
FIG. 1 is a top view of a first embodiment of the dispensing device of the invention.

Referring now to FIG. 1, one embodiment of a dispensing device, designated generally by the numeral 10, is shown according to the present invention. As depicted, dispensing device 10 is of a generally rectangular configuration. It will be understood, however, that a variety of shapes and sizes can be accommodated according to the invention.

Figure 2:
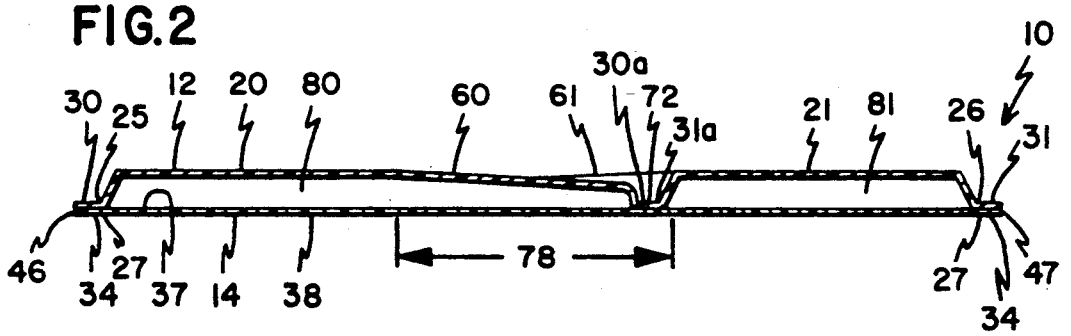
FIG. 2 is a cross-sectional view of the dispensing device shown in FIG. 1, along line 2—2.
Figure 3:
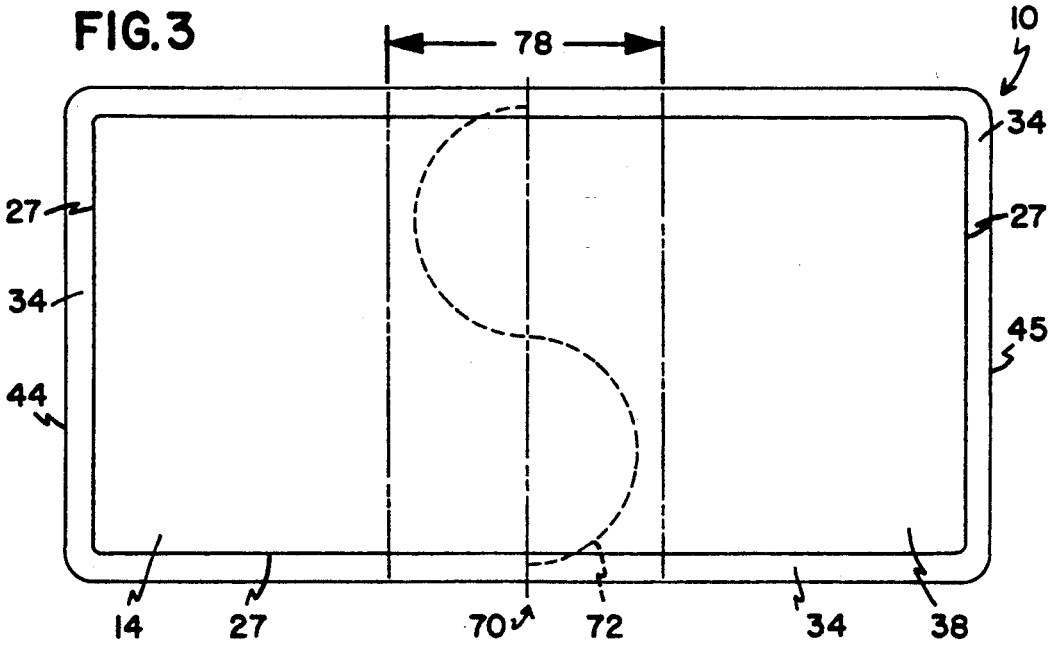
FIG. 3 is a bottom view of the dispensing device shown in FIG. 1.

In general, as shown in FIGS. 1–3, dispensing device 10 is shown having a first surface portion 12 and a second surface portion, or backing sheet 14. Referring to FIG. 1, first surface portion 12 comprises two receptacle units 20, 21. Each receptacle unit 20, 21 has a distal end portion 40, 41, a proximal end portion 50, 51, and peripheral edges 25, 26 extending completely around the first and second receptacle unit, respectively. Integrally attached to peripheral edges 25, 26 are peripheral flanges 30, 31 which also extend completely around the first and second receptacle unit, respectively. Proximal end portions 50, 51 are formed to provide at least one extension member 60, 61. As depicted in FIG. 1, each receptacle unit 20, 21 of dispensing device 10 includes one extension member 60, 61 that forms a nub or finger-like projection in proximal end portion 50, 51.

Receptacle units 20, 21 are arranged head-to-head with proximal end portions 50, 51 facing or pointed toward each other. In this arrangement, extension members 60, 61 are positioned adjacent to each other in a side-to-side arrangement in which the extension members 60, 61 overlap an axis 70, as indicated by the broken line, that extends between receptacle units 20, 21, and across the width of dispensing device 10.

Although not necessary, it is preferred that at least a portion of first receptacle unit 20 along peripheral edges 25*a* adjacent to extension member 60 is integrally attached to second receptacle unit 21 along peripheral edges 26*a* adjacent to extension member 61. Preferably, a score line is provided thereinbetween for detaching the receptacle units from each other. For example, as depicted in FIG. 1, peripheral flange 30*a* of first receptacle unit 20 adjacent to extension member 60 is integrally attached to peripheral flange 31*a* of second receptacle unit 21 adjacent to extension member 61. A score line, indicated by the broken line designated as 72, is provided thereinbetween for detaching receptacle unit 20 from receptacle unit 21 when the dispensing device 10 is opened.

FIGS. 1–3 illustrate an integrally formed first surface portion 12 with receptacle units 20, 21. According to the invention, score line 72 is separated upon bending of dispensing device 10 and forcing together distal ends 46, 47 of dispensing device 10, as described hereinbelow. It is understood that score line 72 may be a fracture line, perforations or other like means for separating first receptacle unit 20 from second receptacle unit 21. Where first and second receptacle units 20, 21 are not integrally attached together along peripheral flanges 30*a*, 31*a*, broken line 72 may designate a separation between the two units.

Dispensing device 10 further includes a flexible backing sheet 14, as depicted in FIG. 3. Backing sheet 14 includes distal ends 44, 45, first surface 37, second surface 38, peripheral edges 27 which extend completely around backing sheet 14, and peripheral flanges 34 which are integrally attached to peripheral edges 27.

As shown in side view in FIG. 2, receptacle units 20, 21 are sealed along their peripheral edges 25, 26 to backing sheet 14. More specifically, as depicted, peripheral flanges 30, 31 of receptacle units 20, 21 are sealed to inner surface 37 of backing sheet 14 along peripheral edges 27 and peripheral flanges 34, and in central region or zone 78 of backing sheet 14 to form at least two sealed interior chambers 80, 81, thereinbetween for containing a flowable or solid substance. At least a portion of backing sheet 14, designated in FIGS. 2 and 3 as zone 78, is releasably attached along peripheral edges 25*a*, 26*b* and peripheral flanges 30*a*, 31*a* located adjacent to extension members 60, 61.

The material used for receptacle units 20, 21 and backing sheet 14 should be relatively puncture resistance, non-absorbent, and impermeable, chemically compatible and non-reactive with the flowable substance or article contained in the dispenser unit to prevent leakage or migration of the contents out of the interior chambers, and substantially impermeable to external contaminants such as air, dust, liquids and the like.

Suitable materials for backing sheet 14 include those that are capable of being flexed when distal ends 46, 47 of dispensing device 10 are forced together. The material used for backing sheet 14 should also be capable of being sealed to receptacle units 20, 21 to form a containing and dispensing package that does not separate during normal use. For example, backing sheet 14 may be made of a thermoplastic and heat sealable polymeric film material, such as polyethylene, polyvinyl chloride, or polyamide-type resins, according to known techniques in the art. Such a film may be used alone or adhered to a non-heat sealable material by known techniques. Backing sheet 14 may be formed, for example, of glassine paper, cellophane, polyethylene, polypropylene, polyvinyl chloride, polyester, nylon and the like. Backing sheet 14 may also be formed of an aluminum foil that is coated or sealed with a thermoplastic material such as a polyethylene, polyester, polyvinyl resin or cellulose acetate. Alternatively, the foil may comprise a cellulosic material lined with a thermoplastic film or other synthetic or plastic material. A foil-lined paper board may also be used. For examples of flexible materials suitable for backing sheet 14, see for example, "Coatings and Laminations," in Handbook of Package Engineering (2d ed.), pages 4-1 to 4-20, J. F. Hanlon, the disclosure of which is incorporated by reference herein.

Backing sheet 14 may be formed of a laminate or covered with a lamination that includes components such as fluorohalocarbon (Aclar), cellulose acetate, cellophane, polyester, polyvinyl chloride (PVC), polyethylene (PE), polypropylene, rubber hydrochloride, PVDC, and the like. A laminated backing sheet 14 may include, for example, paper or foil with polyester, acetate with foil and lacquer, acetate with metallized Mylar and polyester, and other suitable combinations that will provide, for example, a stiff yet flexible backing sheet 14, a moisture or gas barrier, protection of the contents from photochemical change from exposure to light, prevention of plasticizers and stabilizers from the film by the contents of the package, and other like factors. For example, backing sheet 14 may be formed of a laminated paper board material such as a stiff cardboard that is covered with a foil material and/or a structured film. The layers of the lamination may be sealed together, as for example, by heat.

A coating to provide a nonporous gas and/or vapor barrier, as for example polyethylene and/or polyester, may be applied to the outer surface of backing sheet 14. The coating may provide a sealant to prevent entry of vapors or water, or evaporation of the contents from dispensing device 10, such as alcohol.

Backing sheet 14 may be coated, for example, with a wax coating such as a paraffin wax alone or as part of a blend, as for example, with microcrystalline wax and polyethylene; a varnish coating; a polyvinylidene chloride (PVDC) coating; a polyester (PET) coating, as for example, polyethylene terephtalate; a heat seal coating, as for example, with polyethylene, vinyl, acetate, polyvinyl resin or cellulose acetate, or other cellulosics, or polyvinyl chloride; an extrusion coating, as for example, with polyethylene; or a metallized film coating, as for example, a metallized polyester, nylon, polyethylene, or polypropylene having a thin layer of aluminum. A coextruded or composite film may also be used to cover backing sheet 14. A composite film may include, for example, polyethylene and polypropylene with nylon, EVA, saran, and/or styrene.

Receptacle units 20, 21 may be made of the same or similar material as that used for backing sheet 12. Preferably, receptacle units 20, 21 are formed of a rigid or semirigid synthetic organic polymeric sheet material such as polystyrene, acrilonitride or acrylic copolymer with polystyrene, for example by extrusion, thermoforming, vacuum-forming, or other technique known in the art. A coating to provide a nonporous gas and/or vapor barrier, as for example, a coating, a co-extruded plastic such as polyethylene and polyethylene terephtalate, or a laminate of these materials and others such as polypropylene, polyvinylidene chloride, cellophane, and the like, may be applied to the outer surface of receptacle units 20, 21 as a sealant to prevent entry of vapors or water, or evaporation of the contents of dispensing device 10, such as alcohol.

A heat seal, pressure seal, high frequency seal, ultrasonic seal, a crimp, a bonding material or various adhesive materials, or other suitable attachment method or means, may be used to effect a secure seal according to known techniques in the art. For example, heat may be applied according to known techniques in the art to cause a bonding of the thermoplastic liner of backing sheet 14 to receptacle units 20, 21. A temporary heat seal may be formed by applying relatively narrow lines of heat seal, and wider lines of heat seal may be applied to effect a more permanent seal. A permanent seal may also be provided by applying a high degree of heat using an appropriately high temperature, and a lower degree of heat using a lower temperature to provide a temporary seal.

Adhesives used for sealing should be non-reactive and compatible with the materials used for receptacle units 20, 21 and backing sheet 14 as well as the contents of dispensing device 10, and should not permit premature leakage or diffusion of such materials from the package. An example of adhesives for effecting a releasable seal include, for example, polyvinyl chloride (PVC) applied to one surface, and polyvinyl acetate applied to a second surface.

Receptacle units 20, 21 and backing sheet 14 may also be sealed together by a piece of material (not shown) attached between receptacle units 20, 21 and backing sheet 12 along peripheral edges 25, 26 to form a side wall.

In a second embodiment of the invention, as depicted in FIGS. 4–6, dispensing device 110 is shown as having receptacle units 120, 121, being formed to provide a plurality of extension members 164*a–d*, 165*a–d*, which are similar in structure and function as receptacle units 20, 21 and extension members 60, 61 of the first embodiment as shown in FIGS. 1–3. As depicted in FIG. 4, the extension members are positioned in a staggered arrangement, such that the placement of an extension member of first receptacle unit 120 will alternate with an extension member of second receptacle unit 121. More particularly, extension members 164*a*, 164*b*, 164*c*, and 164*d* of the first receptacle unit 120 alternate in placement with extension members 165a, 165b, 165c, and 165d of the second receptacle unit 121 across the width of dispensing device 110.

As with the dispenser device 10 depicted in FIGS. 1-3, dispenser device 110 includes receptacle units 120, 121 with peripheral edges 125, 126, 125a, 126a, and peripheral flanges 130, 131, 130a, 131a, which are similar in structure and function to peripheral edges 25, 26, 25a, 26a, and peripheral flanges 30, 31, 30a, 31a, respectively, of dispenser device 10. Likewise, bending axis 170 is similar to bending axis 70, and distal ends 146, 147 are similar to distal ends 46, 47. Like dispensing device 10 depicted in FIGS. 1-3, dispensing device 110 is shown in FIGS. 4-9 as having an integrally formed first surface portion 112 with receptacle units 120, 121 integrally attached at peripheral flanges 130a, 131a with a score line 172 thereinbetween. It is understood that the receptacle units need not be integrally attached, and that broken line 172 may designate a separation line thereinbetween the units. Dispenser device 110 also includes backing sheet 114 with peripheral edges 127, and peripheral flanges 134.

As depicted in FIG. 4-9, a receptacle unit may include one or more divider walls in the interior chamber to provide one or more subchambers for isolated containment of a substance or article. Such a divider wall may be formed by any method suitable for providing a division of the interior chamber for separate and sealable containment of a substance. It is preferred that a permanent sealing means is used in forming a dividing wall.

For example, a receptacle unit and backing sheet may be sealed together to form a divider wall. As depicted in FIGS. 4-6, dispensing device 110 is shown as having two divider walls 186a and 186b, and one divider wall 187 that separates interior chambers 180, 181, respectively, into subchambers. For example, to form divider walls 186a, 186b and provide subchambers 184a, 184b, 184c, a portion of receptacle unit 120 and backing sheet 114 may be sealed together in a seam, as for example by heat sealing or by use of an adhesive compound. Two alternative divider walls are depicted in FIG. 5 as divider walls 186a, 186b, and in FIG. 6 as divider walls 192a, 192b. It is understood that one or more subchambers 185a, 185b may likewise be formed inbetween second receptacle unit 121 and backing sheet 114. FIG. 4 shows a top view of dispensing device 110 as having two subchambers 185a, 185b in second receptacle unit 121 with divider wall 187. It is to be noted that dispensing device 110 can be made without any divider walls.

Figure 7:
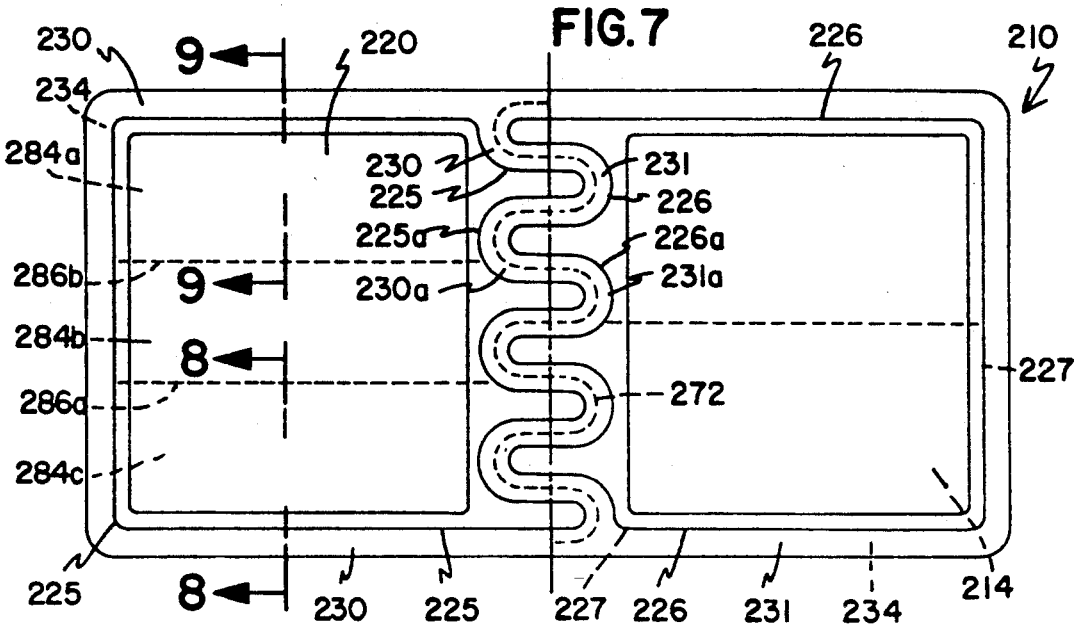
FIG. 7 is a top view of a third embodiment of the dispensing device.

In another example of divider walls provided for forming subchambers, a third embodiment of the dispensing device is shown in FIGS. 7-9 and designated generally as 210. Dispenser device 210 is similar in structure and function to dispensing device 110 shown in FIG. 4. A portion of receptacle unit 220, for example, may be molded, shaped or otherwise provided with a partition structure 288a, which extends from inner surface 235 of receptacle unit 220. As shown in FIG. 8, to form dispenser device 210, receptacle unit 220 at peripheral edges 225 and peripheral flanges 230, is sealed to backing sheet 214 at peripheral edges 227 and peripheral flanges 234. In sealing together receptacle unit 220 and backing sheet 214, partition structure 288a would also be sealed to inner surface 237 of backing sheet 214 to provide divider wall 286a. This attachment to receptacle unit 220 and backing sheet 214 would thus form subchambers 284a, 284b. As depicted in cross-sectional view in FIG. 9, an alternative divider wall 286b may be formed by providing a partition structure 286b that extends from inner surface 237 of backing sheet 214, and which would be sealed to inner surface 235 of receptacle unit 220 to form divider wall 286b. Subchambers 284b, 284c would thus be provided by sealing together receptacle unit 220 and backing sheet 214.

Referring to FIGS. 4-6, each subchamber 184a-c, 185a-b is in communication with at least one extension member 164a-d, 165a-d, so that the contents of subchamber 184a-c, 185a-b may be dispensed therefrom when the dispensing device is opened.

Figure 10:
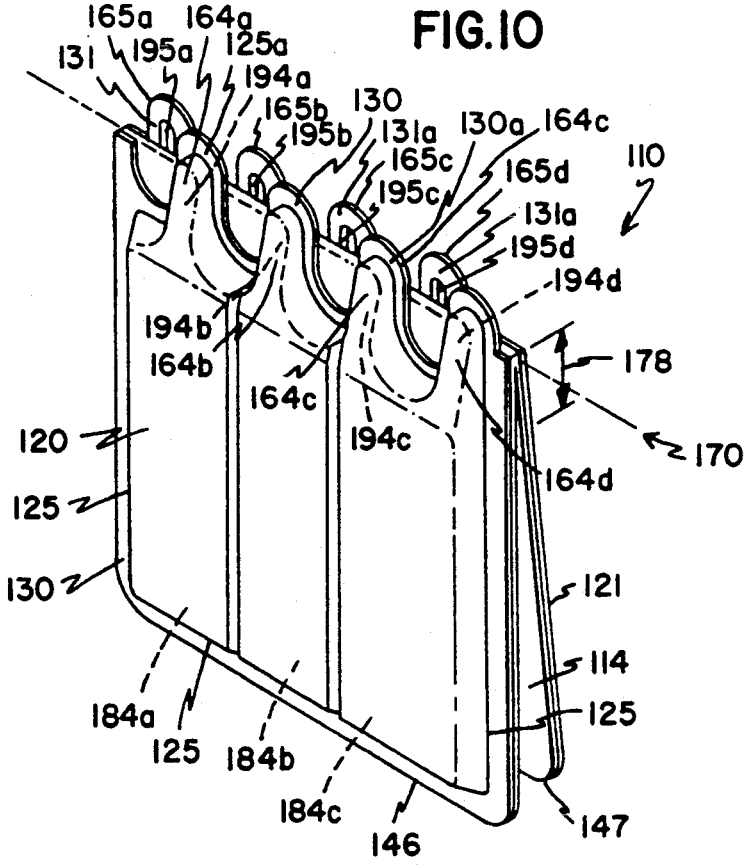
FIG. 10 is a perspective view of the dispensing device of FIG. 4, showing the device in use.

FIG. 10 is a depiction of dispensing device 110 shown in FIGS. 4-6, in an opened arrangement to facilitate dispensing the contents of the device. An article or substance contained within subchambers 184a-c, 185a-b (not shown) is able to be discharged by urging together distal ends 146, 147 to bend dispensing device 110 about bending axis 170 that extends across the width of dispensing device 110 and between receptacle units 120, 121. This movement causes backing sheet 114 to be flexed about bending axis 170. Backing sheet 114 may optionally include, for example, a fold or fracture line that extends along bending axis 170, and which may be, for example, a scored or perforated line to facilitate bending of dispensing device 110. Where extension members 164a-d, 165a-d are integrally attached with a score line thereinbetween, the bending action further causes the score line to fracture, and the receptacle units 120, 121 to become detached.

This bending action causes extension members 164a-d, 165a-d to separate from backing sheet 114 in zone 178. In zone 178, backing sheet 114 is releasably sealed to receptacle units 120, 121 at peripheral edges 125a, 126a and, more particularly as depicted, peripheral flanges 130a, 131a. The bending of dispensing device 110 further causes the extension members to pivot upward into finger-like projections.

According to the invention, the portion of the extension members that extends over the bending axis 170, designated as 162a-d, 163a-d in FIG. 4, is not necessary for separating the receptacle units 120, 121 from backing sheet 114. Rather, it is that portion of receptacle unit 120 that includes extension members 164a-b up to about the bending axis 170, that acts as a lever to separate the backing sheet 114 from receptacle unit 121. Likewise, it is that portion of receptacle unit 121 with extension members 165a-b up to about bending axis 170 that acts as a lever to separate the backing sheet 114 from receptacle unit 120.

Figure 11:
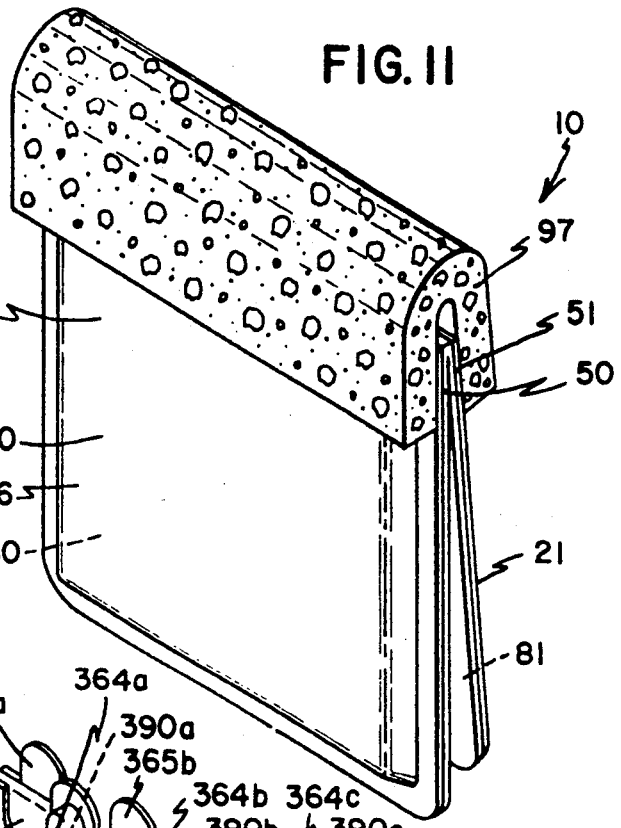
FIG. 11 is a perspective view of the dispensing device of FIG. 1, showing the applicator pad attached thereto.

The separation of extension members 164a-d, 165a-d from backing sheet 114 uncovers openings leading to subchambers. More particularly, as depicted in FIG. 10, opening 194a leads to subchamber 184a, opening 194b to subchamber 184b, and openings 194c, 194d to subchamber 184c. Additionally, openings 195a and 195b lead to subchamber 185a (not shown), and openings 195c and 195d lead to subchamber 185b (not shown). The contents of the subchambers may then be dispensed through their respective openings. It is to be appreciated that device 110 can be bent while in any orientation, not just as shown in FIG. 11. Device 10 operates similarly to device 110.

It is understood according to the invention that interior chambers 80, 81, as depicted in FIGS. 1-3, and subchambers such as 184a-c, 185a-b depicted in FIGS. 4-5, may each contain the same or different substances. Advantageously, the dispensing device of the invention may be used to dispense two or more substances that should be, or are preferably, kept separated until the desired application. For example, referring to FIGS. 1-3, dispensing device 10 may be used to separately contain and dispense the components of an epoxy cement mixture. In such case, for example, interior chamber 80 of first receptacle unit 20 may contain a filler or epoxy resin,-and interior chamber 81 of second receptacle unit 21 may contain a hardener or activator composition. The two components would then be dispensed according to the invention simultaneously from the two interior chambers 80, 81 and mixed together to form an epoxy cement. In another example, dispensing device 110, as depicted in FIGS. 4-5, may, for example, be used to separately store and dispense from subchambers 184*a-c*, 185*a-b*, a number of spices, such as salt, pepper, chili powder, oregano, and cayenne. Alternatively, several different pharmaceutical lotions or ointments may be stored in the subchambers of device 110.

FIG. 11 depicts dispensing device 10 as shown in FIGS. 1-3, with an attached structure, or applicator member 97 for applying the contents dispensed from interior chamber 80, 81. Applicator member 97 may be securely attached to dispensing device 10 by known techniques in the art. As depicted, applicator means 97 is a porous applicator such as a sponge which is secured to exterior surface 36 of first surface portion 12, preferably over proximal ends 50, 51 of receptacle units 20, 21. In this way, when dispensing device 10 is opened as described hereinabove, the contents from interior chambers 80, 81 are released through the openings in the extension members (not shown) and into applicator means 97. Applicator means 97 may be made, as for example, of a gauze material, plastic foam, synthetic cotton or fabric, or other nonwoven material capable of absorbing the liquid or flowable substance. Another applicator useful according to the invention is, for example, a sheet of plastic or stiff paper having pores through which a powder or granular substance, or flowable substance, may be dispensed.

Figure 12:
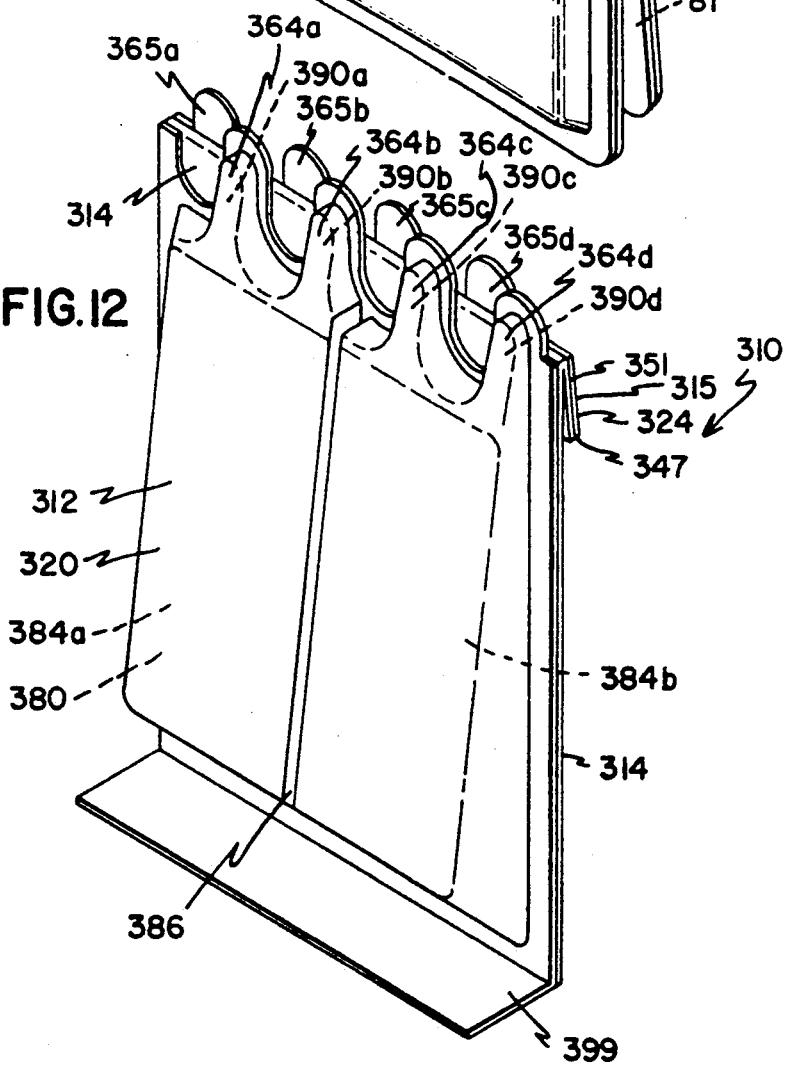
FIG. 12 is a perspective view of a third embodiment of the invention.

FIG. 12 illustrates yet another embodiment of the dispensing device of the invention which is shown opened, and designated generally as 310. Dispensing member 310 includes first surface portion 312 and, second surface portion, or backing sheet 314. As depicted, first surface portion 312 includes a first receptacle unit 320 and an opening member 324, sealed to backing sheet 314 to provide an interior chamber 380 in first receptacle 320. As shown, interior chamber 380 may be further divided into subchambers 384*a*, 384*b*. Opening member 324 with extension members 365*a-d* is somewhat like second receptacle unit 121 depicted in FIGS. 4 and 6, except that opening member 324 is abbreviated at a point just beyond proximal end 315 so that no interior chamber is provided therein. Opening member 324 includes a distal end 347 and proximal end 351. The function of opening member 324 is similar to second receptacle unit 121 in that opening member 324 cooperates with first receptacle unit 320 to separate extension members 364*a-d*, 365*a-d* from backing sheet 314 to uncover openings 390*a-d* in first receptacle unit 320. As depicted in FIG. 12, openings 390*a*, 390*b* in extension members 364*a*, 364*b*, respectively, lead to subchamber 384*a*, and openings 390*c* and 390*d* in extension members 364*a*, 364*d*, respectively, lead to subchamber 384*b*.

As depicted in FIG. 12, first receptacle unit 312 may be formed in a wedge-shape, and backing sheet 314, or first receptacle unit 312 as shown, may further include base member 399 for positioning dispensing device 310 in an upward, or vertical position. It is again understood that a variety of shapes and sizes and thicknesses can be accommodated according to the invention. This self-standing package is particularly useful as a shaker for dispensing solid articles, as for example, seasonings, such as salt, pepper, and oregano, alone or in combination with the components contained in dispensing device with a single interior chamber without a dividing wall (not shown), or in a dispensing device 310 with a dividing wall 386, as shown in FIG. 12, and one or more subchambers, shown here as two subchambers 384*a*, 384*b*. According to this embodiment, it is preferred that extension members 364*a-d*, 365*a-b* may be adhesively reattachable to backing sheet 314 after dispensing device 310 is opened so that openings 390*a-d* may be reclosed to contain and protect the contents in dispensing device 310 until it is desired to dispense some or all of the remaining contents.

Thus, the invention has been described with reference to various specific and preferred embodiments and techniques. However, it should be understood that many variations and modifications may be made while remaining within the spirit and scope of the invention, and the invention is not to be construed as limited to the specific embodiments shown in the drawings.

What is claimed is:

1. A dispensing device, comprising:

(a) a flexible backing sheet with a first surface and a second surface; and (b) two receptacle units, each of the receptacle units including peripheral edges, and a distal end and a proximal end, each of the proximal ends being formed to provide at least one extension member protruding therefrom, each of the receptacle units being sealed along the peripheral edges to the first surface of the backing sheet to form at least one sealed interior chamber thereinbetween for containing a flowable or solid substance, at least a portion of the backing sheet being releasably attached along the peripheral edges of the proximal ends of the receptacle units, the receptacle units positioned on the backing sheet with the proximal ends adjacent to each other and the extension members of the receptacle units overlapping an axis extending between the receptacle units and across a width of the dispensing device;

wherein at least a portion of the backing sheet is separable from the extension members of the first and second receptacle units by urging together the distal ends of the receptacle units to bend the dispensing device about the axis, so that an opening to the interior chambers of the dispensing device is provided and the substance within the chambers are dispensable therefrom.

2. A dispensing device according to claim 1, wherein at least a portion of the first receptacle unit adjacent to its extension member is integrally attached to the second receptacle unit, the integrally attached portion having a score line therethrough, the receptacle units being separable along the score line during urging of the distal ends of the dispensing device together.

3. A dispensing device according to claim 1, wherein each of the receptacle units comprises a plurality of extension members, each extension member forming an opening into one of the interior chambers.

4. A dispensing device according to claim 3, wherein the backing sheet is sealed to one of the receptacle units to form a plurality of sealed interior subchambers thereinbetween, each of the subchambers in communication with at least one of the openings formed by the extension members.

5. A dispensing device according to claim 4, wherein the backing sheet and the receptacle units are sealed together by heat sealing or by an adhesive.

6. A dispensing device according to claim 1, further comprising an applicator member for applying the substance to a surface, the applicator member being attached to an exterior surface of the receptacle units.

7. A dispensing device according to claim 6, wherein the applicator member is a foam pad.

8. A dispensing device according to claim 1, wherein the backing sheet is made of a deformable plastic coated foil.

9. A dispensing device, comprising:

(a) two receptacle units, each of the receptacle units including a peripheral edge having a flange extending therefrom, each of the receptacle units having a distal end and a proximal end, each of the proximal ends being formed to provide at least one extension member protruding therefrom; and (b) a backing sheet with a first surface sealed to each of the receptacle units at the peripheral flanges to form at least one sealed interior chamber between each receptacle unit and the backing sheet for containing a flowable or solid substance, the backing sheet further being releasable from the receptacle units along a releasably attached portion of the peripheral flanges of each receptacle unit adjacent to the extension members sealed to the backing sheet, the receptacle units positioned on the first surface of the backing sheet wherein the extension members of the receptacle units overlap an axis extending between the receptacle units and across a width of the dispensing device;

wherein at least a portion of the releasably attached portion of the backing sheet is separated from the extension members of the first and second receptacle units by urging together the distal ends of the receptacle units to bend the dispensing device about the axis extending the width of the dispensing device such that an opening to the interior chambers of the dispensing device is provided from which the substance within the chambers are dispensable.

10. A dispensing device according to claim 9, wherein at least a portion of the peripheral flange of the first receptacle unit adjacent to the extension member is connected to the peripheral flange of the second receptacle unit with a score line thereinbetween for disconnecting the receptacle units, the score line separating upon bending of the dispensing device to force the distal ends of the dispensing device together.

11. A dispensing device according to claim 9, wherein the peripheral edges define a plane.

12. A dispensing device, comprising:

(a) a backing sheet with a first surface and a second surface;

(b) an opening member including peripheral edges, a distal end and a proximal end, the opening member being attached along its peripheral edges to the first surface of the backing sheet; at least a portion of the backing sheets being releasably attached along the peripheral edges of the proximal end of the opening member; and (c) a receptacle unit including peripheral flanges, a distal end and a proximal end, the proximal end being formed to provide at least one extension member protruding therefrom, the peripheral flanges of the receptacle unit sealed to the first surface of the backing sheet to form at least one sealed interior chamber thereinbetween for containing a flowable or solid substance, at least a portion of the backing sheet being releasably attached along the peripheral flanges of the proximal end of the receptacle unit, the receptacle unit and the opening member positioned on the backing sheet with the proximal ends adjacent each other, the extension member of the receptacle unit overlaps an axis extending between the receptacle unit and the opening member and across the width of the dispensing device;

wherein at least a portion of the backing sheet is separable from the extension member of the receptacle unit and the proximal end of the opening member by urging together the distal end of the opening member and the distal end of the receptacle unit to bend the dispensing device about the axis, so that an opening to the interior chamber of the receptacle unit is provided and the substance within the chamber is dispensable therefrom.

13. A dispensing device accord to claim 12, wherein the opening member forms a second receptacle unit.

14. A dispensing device according to claim 12, wherein at least a portion of the peripheral edge of the receptacle unit adjacent to the extension member thereof is connected to the opening member with a score line thereinbetween for disconnecting the receptacle unit and the opening member, the score line separating upon bending of the dispensing device.

15. A dispensing device according to claim 12, further comprising a plurality of extension members protruding from the proximal end of the receptacle unit.

16. A dispensing device according to claim 15, further comprising a plurality of extension members protruding from the proximal end of the opening member.

17. A dispensing device according to claim 15, wherein the backing sheet is sealed to the receptacle unit to form a plurality of sealed interior subchambers thereinbetween, each of the subchambers in communication with at least one of the openings formed by the extension members.

18. A dispensing device according to claim 12, further comprising means for applying the substance.

* * * * *